US010647112B2

(12) United States Patent
Kitano et al.

(10) Patent No.: US 10,647,112 B2
(45) Date of Patent: May 12, 2020

(54) LIQUID DROPLET DISCHARGING APPARATUS HAVING MOVEMENT CORRECTION

(71) Applicant: Seiko Epson Corporation, Tokyo (JP)

(72) Inventors: Yoji Kitano, Chino (JP); Junichi Okamoto, Shiojiri (JP)

(73) Assignee: Seiko Epson Corporation (JP)

( * ) Notice: Subject to any disclaimer, the term of this patent is extended or adjusted under 35 U.S.C. 154(b) by 0 days.

(21) Appl. No.: 16/105,038

(22) Filed: Aug. 20, 2018

(65) Prior Publication Data

US 2019/0054738 A1 Feb. 21, 2019

(30) Foreign Application Priority Data

Aug. 21, 2017 (JP) ..... 2017-158467
Jul. 26, 2018 (JP) ..... 2018-140029

(51) Int. Cl.
*B41J 2/045* (2006.01)
*B41J 2/21* (2006.01)
*B41J 25/00* (2006.01)

(52) U.S. Cl.
CPC ..... *B41J 2/04556* (2013.01); *B41J 2/04581* (2013.01); *B41J 2/2132* (2013.01); *B41J 25/001* (2013.01)

(58) Field of Classification Search
CPC .... B41J 2/04556; B41J 2/2132; B41J 25/001; B41J 2/04581
See application file for complete search history.

(56) References Cited

U.S. PATENT DOCUMENTS

2002/0158144 A1* 10/2002 Anderson ..... B41J 25/001 239/227
2009/0315934 A1* 12/2009 Moriyama ..... B41J 11/008 347/14

FOREIGN PATENT DOCUMENTS

JP H09-226131 A 9/1997
JP 2010-000699 A 1/2010

* cited by examiner

*Primary Examiner* — Bradley W Thies
(74) *Attorney, Agent, or Firm* — Harness, Dickey & Pierce, P.L.C.

(57) ABSTRACT

A liquid droplet discharging apparatus includes: a first piezoelectric element that moves a head in a first direction; a second piezoelectric element that moves the head in a second direction opposite to the first direction; a movement unit that moves a medium in the first direction in accordance with a predetermined target movement amount; a transport amount measurement unit as a movement amount measurement unit that measures a movement amount of the medium in the first direction; and a drive control unit that controls driving of the first piezoelectric element and the second piezoelectric element. The drive control unit drives either one of the first piezoelectric element or the second piezoelectric element according to a difference B−A between a target transport amount A as the target movement amount and a transport amount B as the movement amount measured from the transport amount measurement unit.

7 Claims, 11 Drawing Sheets

LIQUID DROPLET DISCHARGING APPARATUS HAVING MOVEMENT CORRECTION

BACKGROUND

1. Technical Field

The present invention relates to a liquid droplet discharging apparatus.

2. Related Art

Hitherto, as a liquid droplet discharging apparatus, an ink jet printer (hereinafter, simply referred to as "printer") that discharges ink toward a medium such as printing paper from a head is known. The printer generally prints an image or characters on a medium by transporting the medium in a predetermined transport direction, and discharging ink toward the medium from a head. For a high quality printing, it is necessary to precisely match a relative position between a medium and a head. For example, an ink jet recording apparatus disclosed in JP-A-2010-699 moves a recording head in a transport direction of a recording medium according to an error of a transport amount of the recording medium after transporting the recording medium and adjusts the position of the recording head with respect to the transported recording medium. An ink jet apparatus disclosed in JP-A-9-226131 finely moves a line head in a main scanning direction by applying a voltage to a piezoelectric element provided in an ink jet head and performs alignment between a plurality of heads.

In the technology described in JP-A-2010-699 and JP-A-9-226131, the position of the recording head is adjusted by expanding and contracting the piezoelectric element. However, since the piezoelectric element has hysteresis characteristic and creep characteristic, there are cases that an extension and contraction degree with respect to the same applied voltage, that is, a displacement amount may change. There has been a problem that the change in the displacement amount of the piezoelectric element may cause an error in position control of the recording head, and thereby a deviation in a discharge position of liquid droplets discharged on a medium from a recording head may be generated.

SUMMARY

An advantage of some aspects of the invention is to solve at least a part of the problems described above, and the invention can be implemented as the following forms or application examples.

Application Example

A liquid droplet discharging apparatus according to an application example discharges liquid droplets on a medium from a plurality of nozzles included in a head while relatively moving the head and the medium. The liquid droplet discharging apparatus includes a first piezoelectric element that moves the head in a first direction; a second piezoelectric element that moves the head in a second direction opposite to the first direction; a movement unit that moves the head or the medium in the first direction in accordance with a predetermined target movement amount; a movement amount measurement unit that measures a movement amount of the head or the medium in the first direction; and a drive control unit that controls driving of the first piezoelectric element and the second piezoelectric element. The first piezoelectric element is disposed on a side of the head in the second direction, the second piezoelectric element is disposed on a side of the head in the first direction, and the drive control unit drives either one of the first piezoelectric element or the second piezoelectric element according to a difference B-A between the target movement amount A and the movement amount B measured by the movement amount measurement unit.

According to this application example, by driving either one of the first piezoelectric element or the second piezoelectric element, it is possible to correct a discharge position of the liquid droplets discharged from a plurality of nozzles toward a medium according to the difference B−A between the target movement amount A and the actual movement amount B using an extending direction of the piezoelectric element. Therefore, compare to the case where a single piezoelectric element is used, it is difficult to be influenced by hysteresis characteristic and creep characteristic, and thereby, it is possible to accurately adjust the relative position of the head with respect to the medium.

Application Example

In the liquid droplet discharging apparatus of the application example, it is preferable that the movement unit moves the medium in the first direction, and the drive control unit drives the first piezoelectric element in a case where the difference is a positive value, and drives the second piezoelectric element in a case where the difference is a negative value.

According to this application example, by switching the piezoelectric element to be used depending on whether the movement amount error of the medium is positive or negative, it is possible to correct the discharge position only by adjusting the head position without switching the discharge nozzles. Therefore, it is possible to correct the discharge position with higher accuracy.

Application Example

In the liquid droplet discharging apparatus of the application example, it is preferable that the movement unit moves the head in the first direction, and the drive control unit drives the second piezoelectric element in a case where the difference is a positive value, and drives the first piezoelectric element in a case where the difference is a negative value.

According to this application example, by switching the piezoelectric element to be used depending on whether the movement amount error of the head is positive or negative, it is possible to correct the discharge position only by adjusting the head position without switching the discharge nozzles. Therefore, it is possible to correct the discharge position with higher accuracy.

Application Example

In the liquid droplet discharging apparatus of the application example, it is preferable that the plurality of nozzles are arranged at a pitch P in the first direction, the movement unit moves the medium in the first direction, and the drive control unit drives the first piezoelectric element in a case where the difference is a positive value and is equal to or less than P/2, drives the second piezoelectric element in a case where the difference is a positive value and is greater than P/2, drives the second piezoelectric element in a case where the difference is a negative value and is equal to or less than P/2, and drives the first piezoelectric element in a case where the difference is a negative value and is greater than P/2.

According to this application example, it is possible to further reduce the head position adjustment amount for adjusting the discharge position from selecting and driving the first piezoelectric element or the second piezoelectric element depending on whether the difference B-A between the target movement amount A and the movement amount B of the medium is positive or negative and the size with respect to the length of half of the pitch P of the nozzles. The fluctuation of the displacement amount of the piezoelectric element due to the hysteresis characteristic and the creep characteristic increases as driving potential is large, that is, as the displacement amount increase. Therefore, by further reducing the head position adjustment amount, it is possible to further reduce the driving potential, that is, the displacement amount of the piezoelectric element, further reduce the fluctuation of the displacement amount, and correct the discharge position with higher accuracy.

Application Example

In the liquid droplet discharging apparatus of the application example, it is preferable that, in a case where the difference is a negative value and is greater than P/2, the drive control unit changes a discharge end nozzle on the side in the first direction to an adjacent nozzle on the side in the second direction, in a case where the difference is a positive value and is greater than P/2, the drive control unit changes the discharge end nozzle on the side in the first direction to an adjacent nozzle on the side in the first direction, and, in a case where the difference is a positive value and is equal to or less than P/2, or, in a case where the difference is a negative value and is equal to or less than P/2, the drive control unit does not change the discharge end nozzle on the side in the first direction.

According to this application example, it is possible to reduce the overlap between a discharge region before moving the medium and a discharge region after moving the medium or the occurrence of a region where liquid droplets are not discharged between the discharge region before moving the medium and the discharge region after moving the medium.

Application Example

In the liquid droplet discharging apparatus of the application example, it is preferable that the drive control unit switches the piezoelectric element to be driven between the first piezoelectric element and the second piezoelectric element according to a number of times the first piezoelectric element or the second piezoelectric element is continuously driven.

According to this application example, it is possible to reduce that the piezoelectric element driven for head position adjustment is biased to either the first piezoelectric element or the second piezoelectric element. In a case where the adjustment of the head position is performed with reference to the head position adjusted in the discharge performed before, when the piezoelectric element driven for head position adjustment is biased toward either side, the extension of the piezoelectric element on the biased side is accumulated, and there is a possibility that the amount of displacement of the piezoelectric element will increase. The deviation of the piezoelectric element to be driven is reduced by switching the piezoelectric element according to the number of times of continuous driving. Therefore, an increase in the displacement amount due to accumulation of the expansion of the piezoelectric element is reduced, and it is possible to reduce the fluctuation of the displacement amount due to the hysteresis characteristic and the creep characteristic and to correct the discharge position with higher accuracy.

Application Example

In the liquid droplet discharging apparatus of the application example, it is preferable that the drive control unit alternately drives the first piezoelectric element and the second piezoelectric element.

According to this application example, neither one of the first piezoelectric element nor the second piezoelectric element is continuously driven for head position adjustment. In a case where the adjustment of the head position is performed with reference to the head position adjusted in the discharge performed before, when either one of the piezoelectric elements is continuously driven for head position adjustment, the extension of the continuously driven piezoelectric element is accumulated, and there is a possibility that the amount of displacement of the piezoelectric element will increase. By alternatively driving 2 piezoelectric elements, it is possible to further reduce an increase in the displacement amount due to the accumulated extension of the piezoelectric element. Therefore, it is possible to reduce the fluctuation of the displacement amount due to the hysteresis characteristic and the creep characteristic and to correct the discharge position with higher accuracy.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, embodiments of the invention will be described with reference to the drawings. The drawings to be used are appropriately enlarged or reduced so as to make the explanation part recognizable. However, the following embodiments do not limit the invention according to the appended claims. Not all of the combinations of features described in the embodiments are necessarily essential to the solution means of the invention.

First Embodiment

Liquid Droplet Discharging Apparatus

A liquid droplet discharging apparatus of the present embodiment will be described with reference to FIGS. 1 and 2.

Figure 1:
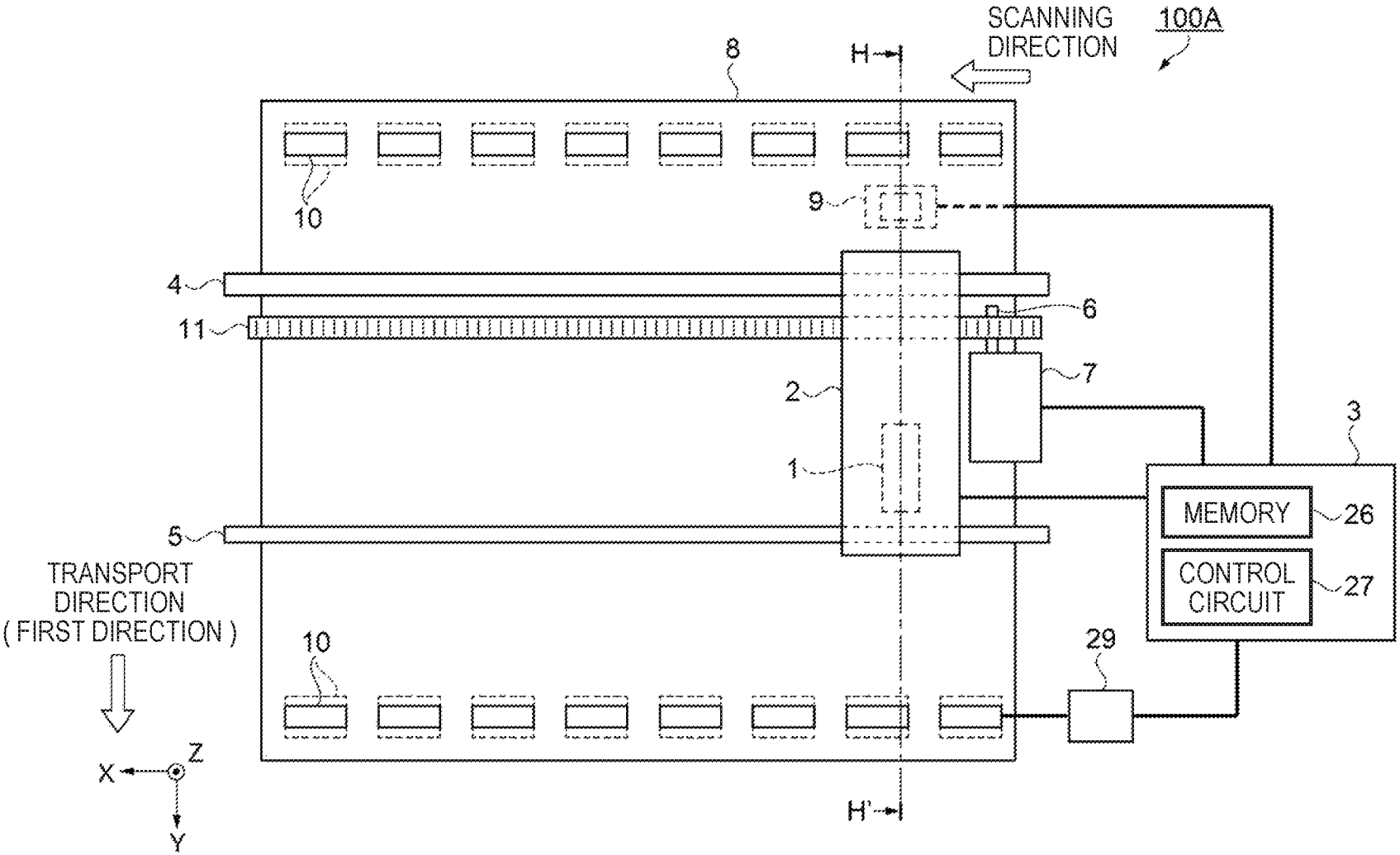
FIG. 1 is a schematic plan view illustrating a configuration of a liquid droplet discharging apparatus.

FIG. 1 is a schematic plan view illustrating a configuration of a liquid droplet discharging apparatus according to the first embodiment. FIG. 2 is a schematic cross-sectional view illustrating the configuration of the liquid droplet discharging apparatus taken along line H-H' of FIG. 1.

Figure 2:
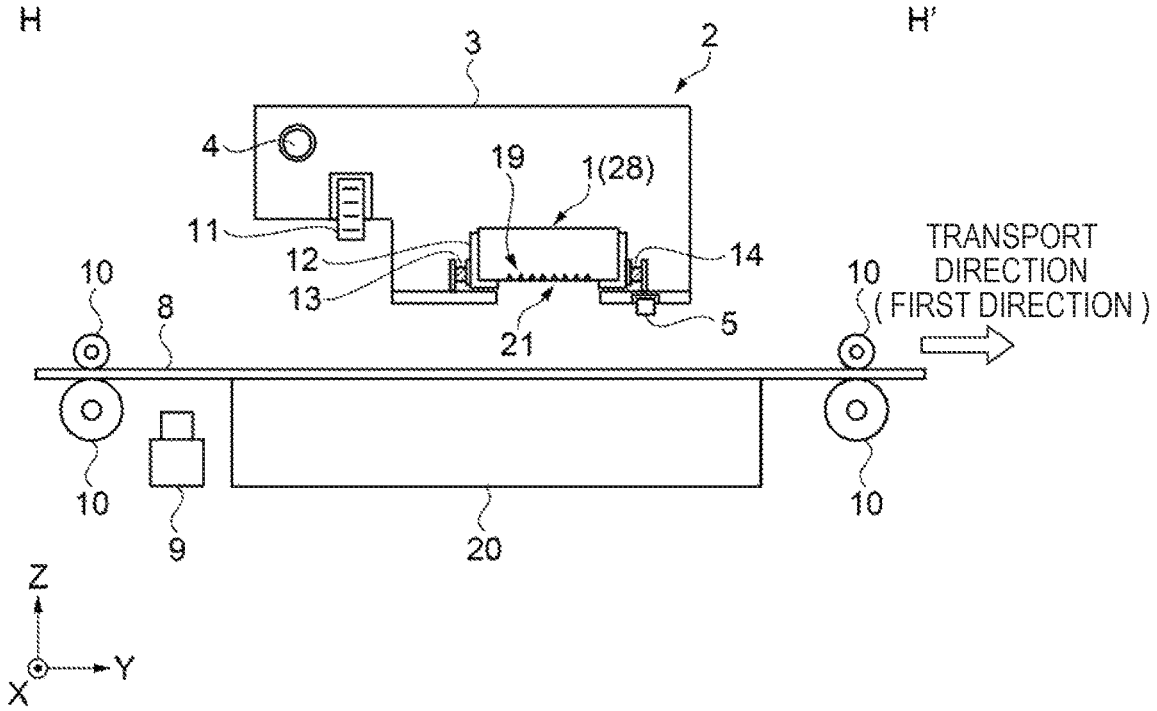
FIG. 2 is a schematic cross-sectional view illustrating the configuration of the liquid droplet discharging apparatus.

As illustrated in FIGS. 1 and 2, a liquid droplet discharging apparatus 100A of the present embodiment is an ink jet printer that discharges ink as liquid droplets toward a medium 8 from nozzles of a head 1. The liquid droplet discharging apparatus 100A includes the head 1, a carriage 2, a control unit 3, a guide shaft 4, a guide rail 5, a scanning belt 11, a scanning drive shaft 6, a head scanning drive unit 7, a transport amount measurement unit 9, a transport roller drive unit 29, a transport roller 10, and a medium support unit (See FIG. 2).

In FIG. 1, arrows X, Y and Z orthogonal to each other are illustrated. Each of the arrows X, Y, and Z indicates a direction with reference to an arrangement posture of the liquid droplet discharging apparatus 100A when in the usual use state that is disposed on a horizontal surface and used. Hereinafter, the directions indicated by the arrows X, Y and Z are referred to as "X direction", "Y direction", and "Z direction", respectively. The X and Y directions are parallel to the horizontal plane. The X direction is parallel to a scanning direction of the liquid droplet discharging apparatus 100A and the Y direction is parallel to a transport direction of the medium 8. The line H-H' is a line segment parallel to the Y direction. The Z direction is opposite to a direction of gravity. In the following description, when referring to as "upper" or "lower", unless otherwise specified, it means upward and downward with reference to the direction of gravity. The X, Y, and Z directions are appropriately illustrated also in each drawing to be referred to later as corresponding to FIG. 1.

The head 1 discharges liquid droplets on the medium 8. On a surface of the head 1 facing the medium 8, a plurality of nozzles 19 (See FIG. 2) are arranged in two rows in series, and a print image represented by print data is printed by forming ink dots on the medium 8 by discharging liquid droplets from the nozzles 19 based on the print data. A head drive circuit 28 is provided in the head 1. A discharge pulse is generated according to an electric signal sent from the control unit 3 in the head drive circuit 28, and liquid droplet discharge of the head 1 is performed by inputting the generated discharge pulse in the head 1.

The carriage 2 is equipped with the head 1, and is movable along the guide shaft 4 and the guide rail 5 in the X direction. The scanning belt 11 (endless belt) that rotates in a direction parallel to the guide shaft 4 and the guide rail 5 is connected with the carriage 2, the carriage 2 moves in the X direction as power is transferred from the head scanning drive unit 7 to the scanning belt 11 via the scanning drive shaft 6, and scanning in the X direction (main scanning) is performed. The head scanning drive unit 7 includes, for example, a motor (not illustrated). The motor operates according to a command from the control unit 3 based on the print data inputted from the outside, and scans the head 1.

The medium 8 is horizontally held by the medium support unit 20 (platen) in a region scanned by the head 1. The medium 8 is, for example, paper, and is transported in the transport direction (first direction) by the transport roller drive unit 29 (movement unit) driving the transport roller 10.

As illustrated in FIG. 2, the transport amount measurement unit 9 is provide at the lower part of the medium 8 on an upstream side of the head 1, and is provided with a light emitting unit that emits measuring light toward the medium 8 and a light receiving unit that receives light from the light emitting unit reflected by the medium 8. The light emitting unit is, for example, an LED, a semiconductor laser, a lamp, or the like. The light receiving unit is, for example, an imaging device such as a CCD or a CMOS image sensor, and it is possible to measure the transport amount of the medium 8 by imaging the medium 8. The transport amount measurement unit 9 may pick up an image of a printing surface of the medium 8 or may pick up an image of a rear surface opposite thereto. The transport amount measurement unit 9 may measure the transport amount of the medium 8 based on changes in the shadow pattern, the pattern, or the like of the imaged medium surface. The transport amount measurement unit 9 of the present embodiment is an example of a movement amount measurement unit according to the invention.

Inside the head 1, an ink chamber communicating with each of the nozzles 19 is provided (not illustrated). The head 1 discharges ink in the ink chamber toward the medium 8 from the nozzles 19 by a known method such as application of pressure to the ink by a piezoelectric element, for example. In the liquid droplet discharging apparatus 100A, the head 1 discharges ink toward the medium 8 from each of the nozzles 19 while moving relative to the medium 8 in the scanning direction. The method of discharging liquid droplets from the head 1 is not limited to the method using the piezoelectric element. In the head 1, a so-called thermal type liquid droplet discharging method may be applied in which liquid droplets are discharged from the nozzles 19 by generating bubbles by heating the ink chamber.

Ink may be supplied to the ink chambers of the head 1 from a cartridge that is detachably attached to the carriage 2.

Alternatively, the ink may be supplied from an ink tank provided at a position separated from the carriage 2 via a pipe member such as a tube disposed in the liquid droplet discharging apparatus 100A.

The control unit 3 includes a memory 26 and a control circuit 27. The memory 26 is electrically connected to the control circuit 27, the control circuit 27 is electrically connected to the head scanning drive unit 7, the head drive circuit 28, the transport roller drive unit 29, and the transport amount measurement unit 9, and it is possible to input and output electric signals, respectively. The control circuit 27 reads print data stored in the memory 26, controls the operation of the head scanning drive unit 7, the head drive circuit 28, a transport roller drive unit, and the transport amount measurement unit 9 based on the print data, and controls the scanning amount, the scanning timing, the discharge amount, and the discharge timing of the head 1, and the transport amount of the medium 8.

The liquid droplet discharge is performed while scanning the head 1 in the scanning direction (X direction) or in the direction opposite to the scanning direction. For example, after performing a first drawing by discharging liquid droplets while performing a first scanning in the X direction, the transport roller 10 is driven to transport the medium 8 in the transport direction and liquid droplets are discharged while performing a second scanning in a direction opposite to the first scanning to draw on the medium 8.

Figure 3:
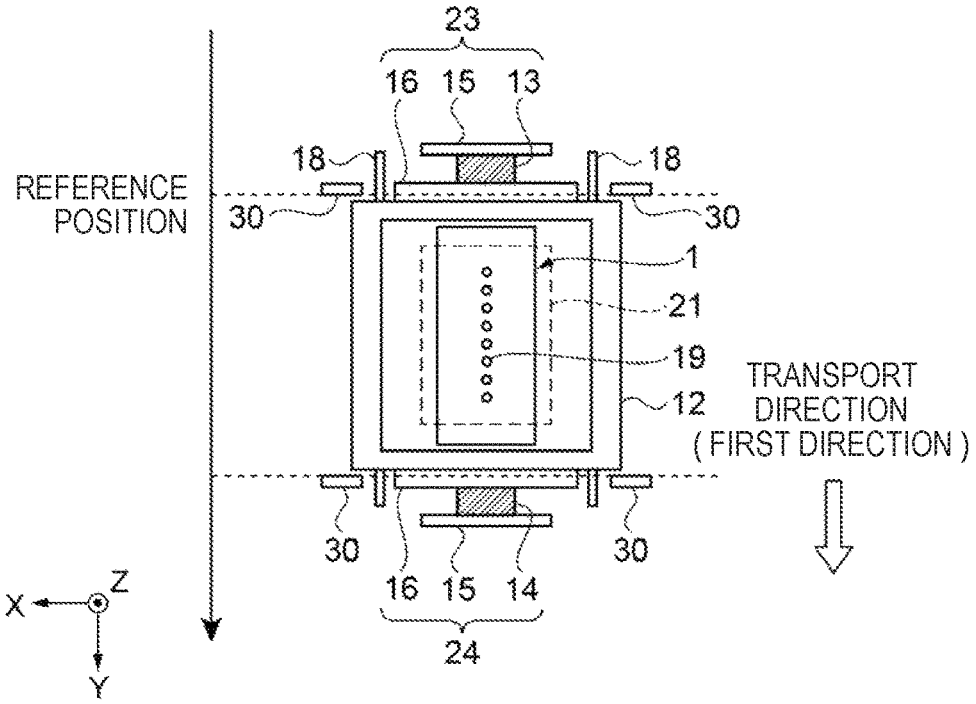
FIG. 3 is an enlarged view of a carriage unit in the liquid droplet discharging apparatus.

FIG. 3 is a plan view of the head 1 viewed from the Z direction. The head 1 is detachably attached to the carriage 2 via a head holding member 12. That is, the worn head 1 can be replaced by removing the head 1 from the head holding member 12. The head holding member 12 has an opening portion 21 in which the region where the nozzles 19 are provided is opened in the plan view as viewed from the Z direction so that the liquid droplets discharged from the nozzles 19 can land on the medium 8.

The head holding member 12 is movable in the first direction (transport direction) by two head guide rails 18 provided along the first direction, and is sandwiched between a first head movement unit 23 and a second head movement unit 24 in the Y direction.

The first head movement unit 23 is configured with a first piezoelectric element 13, a piezoelectric element holding member 15, and an abutting member 16 that connects the first piezoelectric element 13 to the head holding member 12. One end of the first piezoelectric element 13 is fixed to the carriage 2 by the piezoelectric element holding member 15, and the other end thereof is fixed to the head holding member 12 via the abutting member 16. Therefore, as the first piezoelectric element 13 expands, the head 1 held by the head holding member 12 can be displaced in the first direction (transport direction) along the head guide rails 18.

The second head movement unit 24 is configured with a second piezoelectric element 14, the piezoelectric element holding member 15, and the abutting member 16 that connects the second piezoelectric element 14 to the head holding member 12. One end of the second piezoelectric element 14 is fixed to the carriage 2 by the piezoelectric element holding member 15, and the other end thereof is fixed to the head holding member 12 via the abutting member 16. Therefore, as the second piezoelectric element 14 expands, the head 1 held by the head holding member 12 can be displaced in a second direction opposite to the first direction (transport direction).

The first piezoelectric element 13 and the second piezoelectric element 14 are electrically connected to the control unit 3. By controlling the expansion and contraction of the first piezoelectric element 13 or the second piezoelectric element 14 by the control unit 3, the discharge position is adjusted in accordance with the medium transport amount acquired by the transport amount measurement unit 9. The control unit 3 according to the present embodiment is an example of the drive control unit according to the invention.

Figure 4:
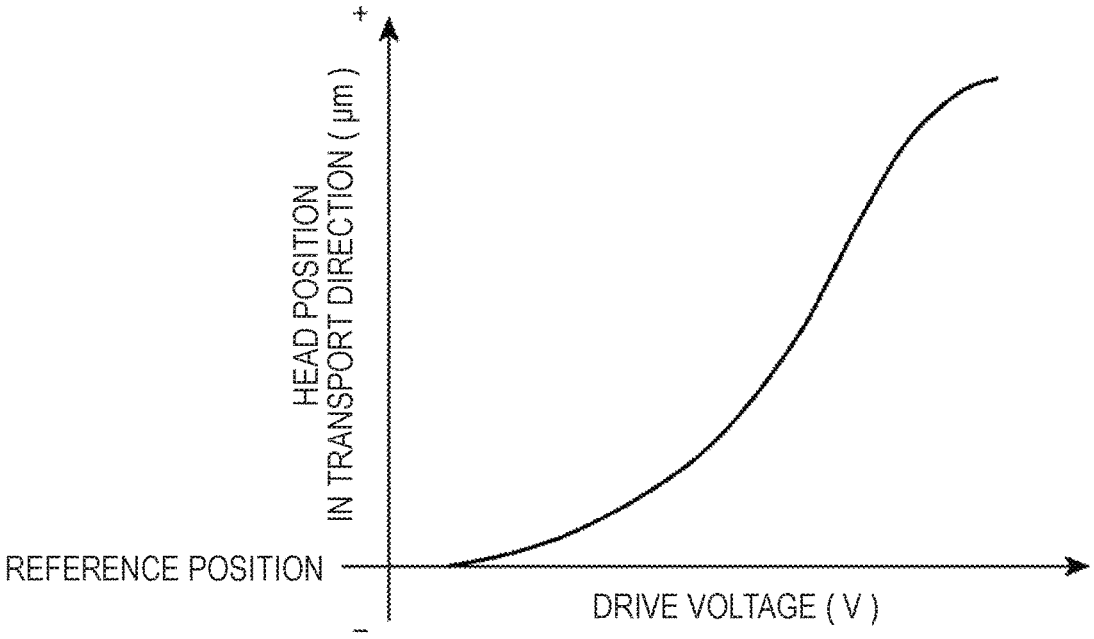
FIG. 4 is a graph illustrating a relationship between a drive voltage of a first piezoelectric element and a head position.
Figure 5:
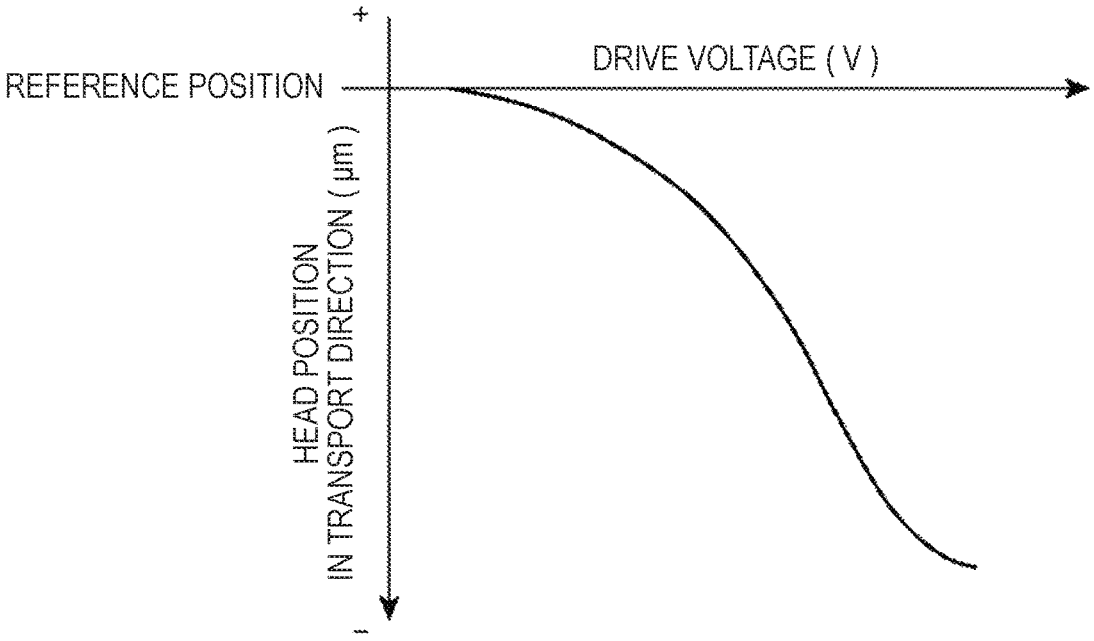
FIG. 5 is a graph illustrating a relationship between a drive voltage of a second piezoelectric element and a head position.

FIG. 4 is a graph illustrating a relationship between a drive voltage of a first piezoelectric element and a head position and FIG. 5 is a graph illustrating a relationship between a drive voltage of a second piezoelectric element and a head position. FIG. 4 illustrates the relationship between the drive voltage applied to the first piezoelectric element 13 and the position of the head 1 from a reference position in the transport direction, and FIG. 5 illustrates the relationship between the drive voltage applied to the second piezoelectric element 14 and the position of the head 1 from a reference position in the transport direction. As illustrated in FIG. 3, for example, the reference position is set by a position at which the carriage 2 contacts a stopper 30 provided on the upstream side in the transport direction of the head holding member 12. The stopper 30 may also be provided on a downstream side of the head holding member 12.

As illustrated in FIG. 4, the expansion amount of the first piezoelectric element 13 varies depending on the applied drive voltage. As the expansion amount varies, it is possible to adjust the position of the head 1 in the transport direction in the + direction (forward direction) with respect to the reference position. As illustrated in FIG. 5, the expansion amount of the second piezoelectric element 14 varies depending on the applied drive voltage. As the expansion amount varies, it is possible to adjust the position of the head 1 in the transport direction in the − direction (reverse direction) with respect to the reference position.

In a case where the transport amount of the medium 8 deviates from the target transport amount after performing the first drawing discharge, the discharge position of the liquid droplets in a second drawing discharge will deviate from the drawing pattern determined by the print data. For example, in a case where the actual transport amount is larger than the target transport amount, the discharge position deviates in a direction opposite to the transport direction than the drawing pattern, that is, a side in the second direction. In a case where the actual transport amount is smaller than the target transport amount, the discharge position deviates in the transport direction from the drawing pattern, that is, the first direction. As described above, the landing positions of the liquid droplets deviate due to the deviation in the discharge position, and unintended streaky print patterns are generated in the print matter, which leads to a serious deterioration in print quality.

In the liquid droplet discharging apparatus 100A according to the present embodiment, after the head 1 performing liquid droplet discharge, and the medium 8 is transported in accordance with the target transport amount A stored in the memory 26 in advance. Next, the transport amount B is acquired by the transport amount measurement unit 9, and the acquired transport amount B is transferred to the control unit 3. In the control unit 3, the control circuit 27 calculates a difference C (B−A) between the target transport amount A read from the memory 26 and the transport amount B transferred from the transport amount measurement unit 9, sends a drive signal to the first piezoelectric element 13 or the second piezoelectric element 14 in accordance with the value of the difference C, and performs the position adjustment of the head 1. That is, by adjusting the position of the head 1 using the first piezoelectric element 13 and the second piezoelectric element 14 in accordance with the actual transport amount, correction of the discharge position is performed. The target transport amount A according to the present embodiment corresponds to the target movement amount Ain the invention, and the transport amount B corresponds to the movement amount B in the invention.

Head Position Adjustment Method

Figure 6:
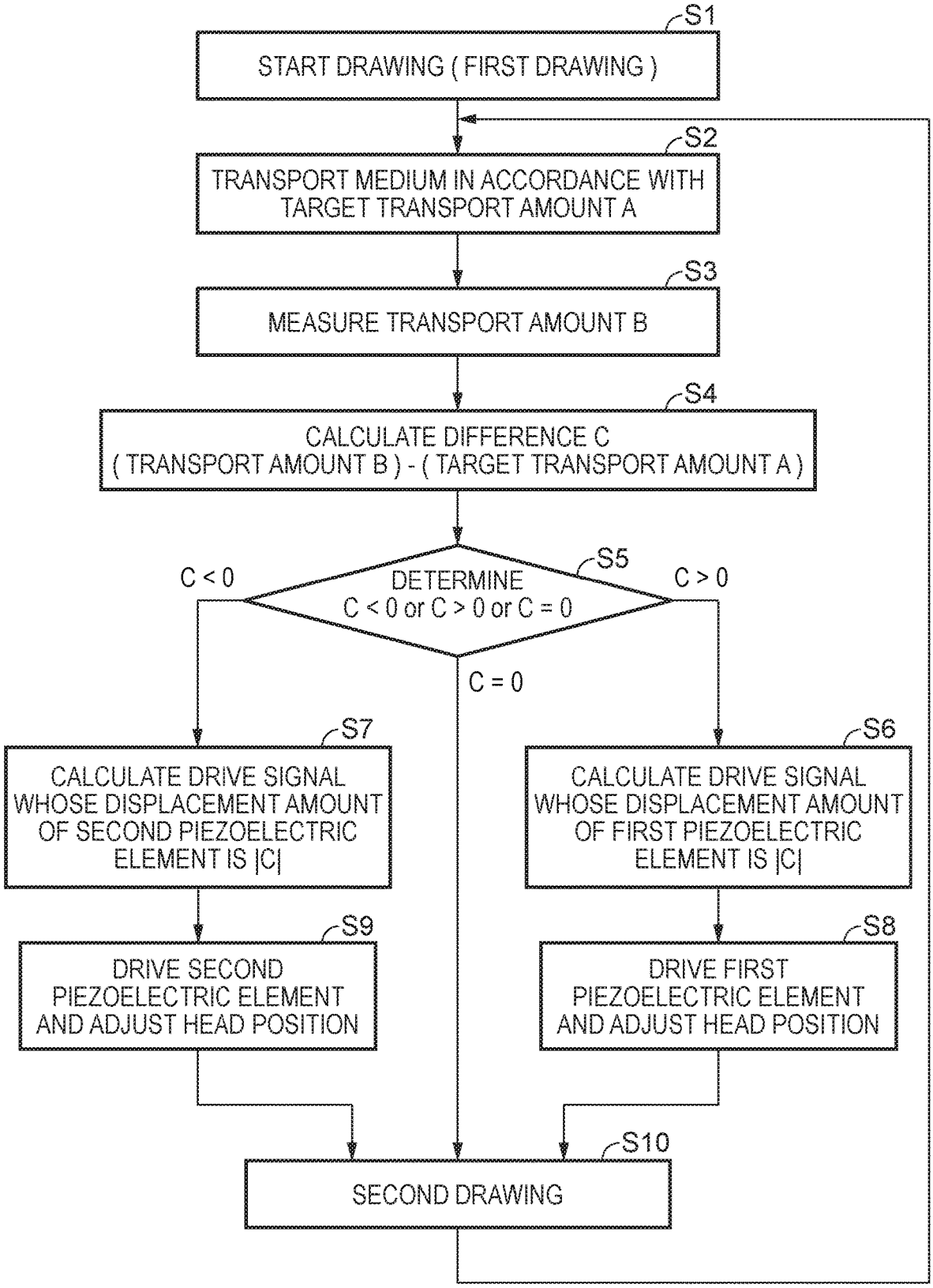
FIG. 6 is a flowchart of a head position adjustment method in a first embodiment.

Next, a head position adjustment method using the first piezoelectric element 13 or the second piezoelectric element 14 will be described with reference to FIGS. 6 to 12. FIG. 6 is a flowchart of the head position adjustment method according to the present embodiment. FIGS. 7 to 12 are diagrams of each process of the head position adjustment method according to the present embodiment. In the present embodiment, the head position adjustment with reduced influence of hysteresis is performed by dividing cases depending on whether the value of the above-described difference C is positive or negative (or 0) and selecting either one of the first piezoelectric element 13 or the second piezoelectric element 14 is to be driven. Hereinafter, steps S1 to S10 in the flowchart in FIG. 6 will be described respectively.

Figure 7:
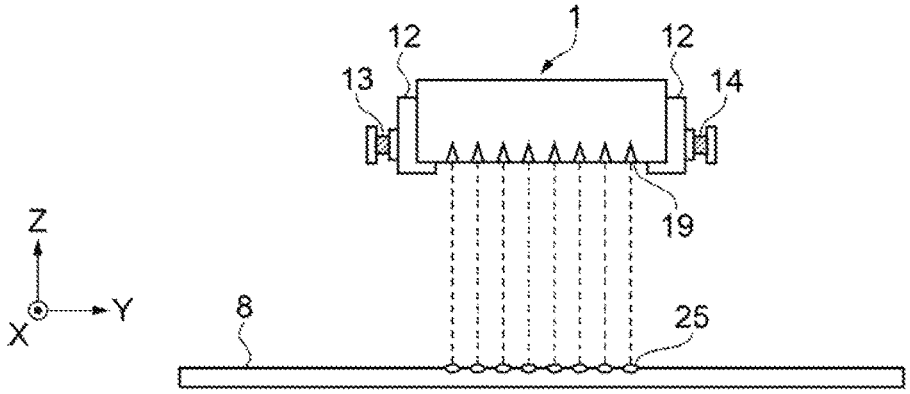
FIG. 7 is a process diagram of the head position adjustment method in the first embodiment.

In step S1, the first drawing discharge is performed, and as illustrated in FIG. 7, liquid droplets are discharged onto the medium 8. Hereinafter, a discharge position of the liquid droplet is indicated by adding a reference numeral 25 to the liquid droplet landed on the medium 8. Then, the process proceeds to step S2.

In step S2, the medium 8 is transported in the first direction in accordance with the target transport amount A. The target transport amount A is stored in the memory 26. The control circuit 27 reads the target transport amount A from the memory 26, a control signal is transferred from the control unit 3 to the transport roller drive unit 29 in accordance with the target transport amount A, and transport of the medium 8 is performed according to the control signal. Then, the process proceeds to step S3.

In step S3, the transport amount B is measured. The transport amount B is measured by taking an image of a front surface (or rear surface) of the medium 8*b* by the transport amount measurement unit 9 according to the signal from the control unit 3. The measured transport amount B is transferred from the transport amount measurement unit 9 to the control circuit 27 of the control unit 3. Then, the process proceeds to step S4.

In step S4, the difference C (B−A) between the transport amount B and the target transport amount A is calculated in the control circuit 27. Then, the process proceeds to step S5.

In step S5, the control circuit 27 determines whether the difference C between the transport amount B and the target transport amount A is C<0 (negative value), C>0 (positive value), or C=0.

In a case where the difference C is C>0 (positive value), the process proceeds to step S6 to calculate the drive signal (drive voltage) of the first piezoelectric element 13. In this case, the drive signal (drive voltage) of the displacement amount corresponding to an absolute value |C| of the difference C is calculated from the relationship between the drive voltage of the first piezoelectric element 13 and the head position illustrated in FIG. 4. After calculating the drive signal (drive voltage), the process proceeds to step S8.

In a case where the difference C is C<0 (negative value), the process proceeds to step S7 to calculate the drive signal (drive voltage) of the second piezoelectric element 14. In this case, the calculation of the drive signal (drive voltage) of the displacement amount corresponding to an absolute value |C| of the difference C from the relationship between the drive voltage of the second piezoelectric element 14 and the head position illustrated in FIG. 5 is performed. After calculating the drive signal (drive voltage), the process proceeds to step S9.

In a case where the difference C is C=0, the calculation of the drive signal (drive voltage) and the adjustment of the head position are not performed, and the process proceeds to step S10.

Figure 8:
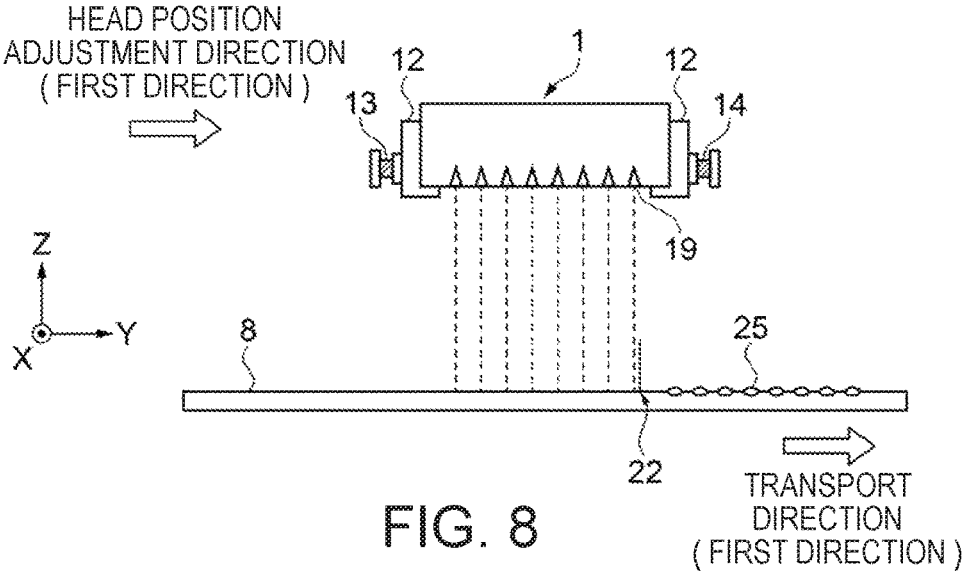
FIG. 8 is a process diagram of the head position adjustment method in the first embodiment.
Figure 9:
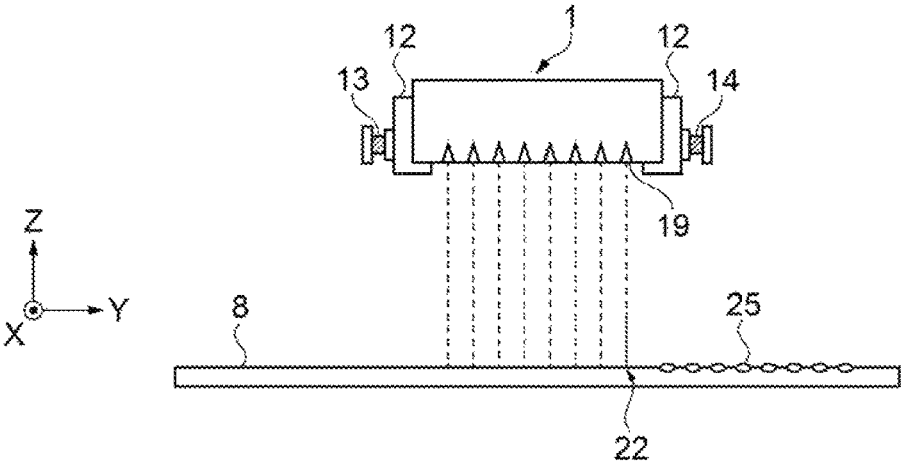
FIG. 9 is a process diagram of the head position adjustment method in the first embodiment.

In step S8, the drive signal (drive voltage) calculated in step S6 is applied to the first piezoelectric element 13, and the adjustment of the head position in accordance with the difference C is performed. As illustrated in FIG. 8, it is possible to move the head 1 by the displacement amount corresponding to the absolute value |C| of the difference C in the first direction by applying the calculated drive signal (drive voltage) to the first piezoelectric element 13 to drive. Before applying the drive voltage to the first piezoelectric element 13, a drive signal (drive voltage) for contracting the contracted length of the second piezoelectric element 14 to the amount of extended length of the first piezoelectric element 13 is applied to the second piezoelectric element 14. As illustrated in FIG. 9, by moving the head 1, it is possible to bring the nozzle position of the head 1 into a state of matching with the target discharge position 22 with higher accuracy. After moving the head 1, the process proceeds to step S10.

Figure 10:
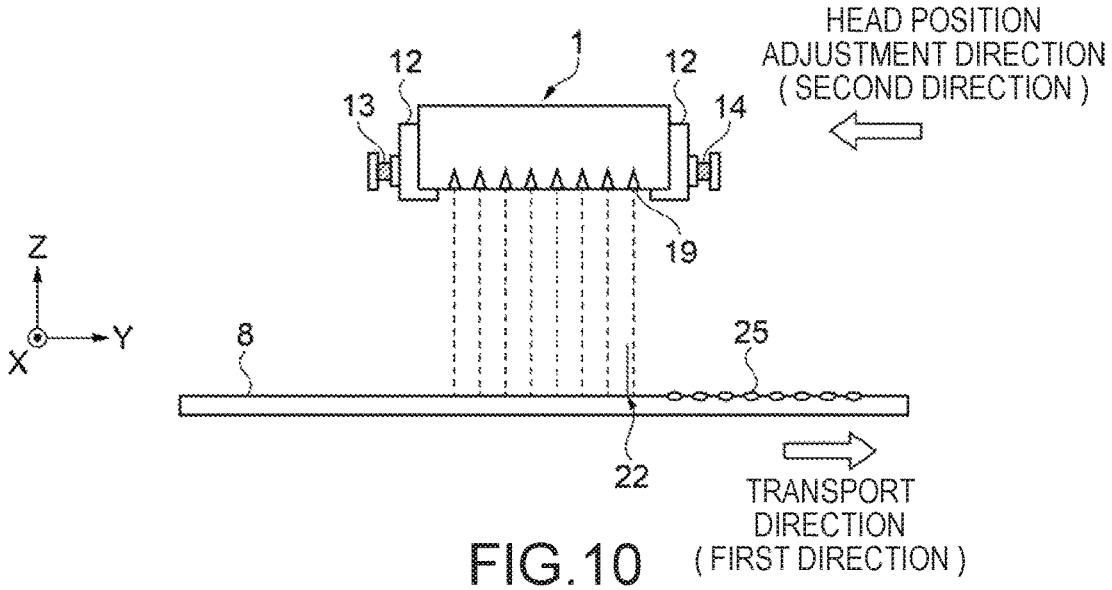
FIG. 10 is a process diagram of the head position adjustment method in the first embodiment.
Figure 11:
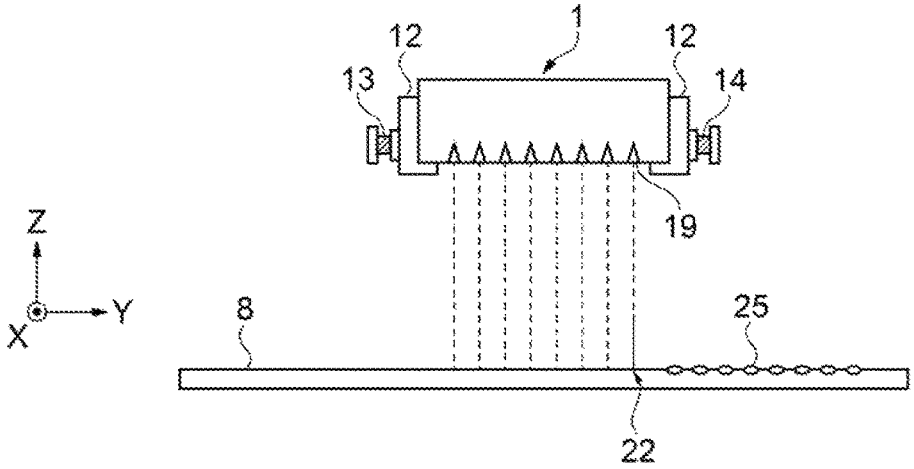
FIG. 11 is a process diagram of the head position adjustment method in the first embodiment.

In step S9, the drive signal (drive voltage) calculated in step S7 is applied to the second piezoelectric element 14, and the adjustment of the head position in accordance with the difference C is performed. As illustrated in FIG. 10, it is possible to move the head 1 by the displacement amount corresponding to an absolute value |C| of the difference C in the second direction opposite to the first direction by applying the calculated drive signal (drive voltage) to the second piezoelectric element 14 to drive. Before applying the drive voltage to the second piezoelectric element 14, a drive signal (drive voltage) for contracting the contracted length of the first piezoelectric element 13 to amount of the extended length of the second piezoelectric element 14 is applied to the first piezoelectric element 13. As illustrated in FIG. 11, by moving the head 1, it is possible to bring the nozzle position of the head 1 into a state of matching with the target discharge position 22 with higher accuracy. After moving the head 1, the process proceeds to step S10.

Figure 12:
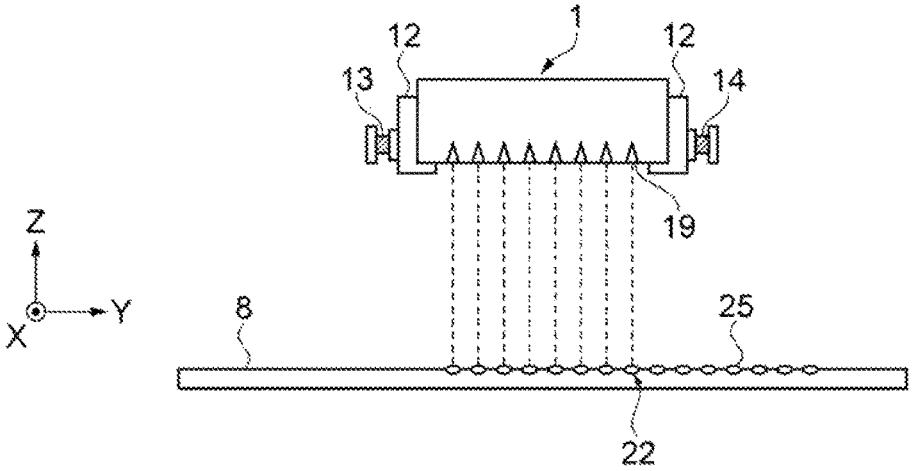
FIG. 12 is a process diagram of the head position adjustment method in the first embodiment.

In step S10, a second drawing discharge is performed. As illustrated in FIG. 12, it is possible to improve the discharge position accuracy by performing the second drawing discharge after performing the head position adjustment. After performing the second drawing discharge, the process returns to step S2 again to transport the medium 8 in accordance with the target transport amount A and repeats steps S3 to S10 again. Thereafter, printing is performed by repeating the steps S2 to S10 a plurality of times.

In the present embodiment, either one of the first piezoelectric element 13 or the second piezoelectric element 14 is driven depending on whether the difference C between the target transport amount A and the actual transport amount B is positive or negative to correct the discharge position of the liquid droplets discharged from the plurality of nozzles 19 on the medium 8. The hysteresis characteristic of a piezoelectric element is generated by repeating extension and contraction of the piezoelectric element. However, in the present embodiment, since the head position adjustment is performed only by the extension of the first piezoelectric element 13 or the second piezoelectric element 14, it is possible to reduce the hysteresis characteristic of a piezoelectric element. The creep characteristic is generated when a voltage is concentratedly applied to a single piezoelectric element. In the present embodiment, the time during which the voltage is applied to the piezoelectric element is dispersed to the first piezoelectric element 13 and the second piezoelectric element 14 compared to the case where a single piezoelectric element is used. Thereby it is possible to reduce the creep characteristic.

Second Embodiment

Next, a head position adjustment method of a second embodiment using the liquid droplet discharging apparatus 100A of the first embodiment will be described with reference to FIGS. 13 to 21.

Figure 13:
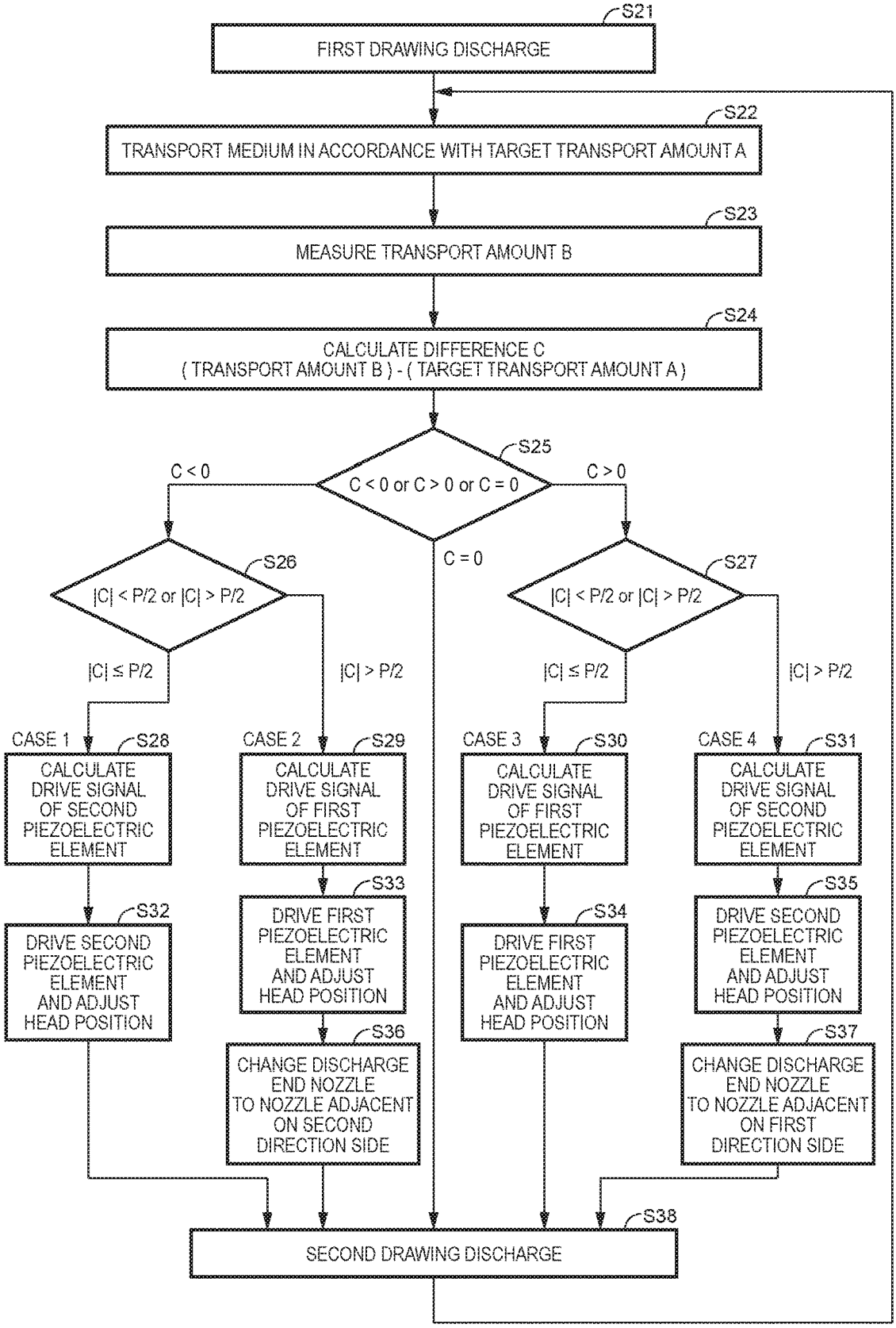
FIG. 13 is a flowchart of a head position adjustment method in a second embodiment.

FIG. 13 is a flowchart of the head position adjustment method in the second embodiment. FIGS. 14 to 21 are schematic diagrams illustrating each process of the head position adjustment method in the second embodiment. In the head position adjustment method using the liquid droplet discharging apparatus 100A of the second embodiment, (case) classification is performed based on the magnitude relationship with ½ of a nozzle pitch P of the nozzles 19 in addition to whether the difference C between the transport amount B and the target transport amount A of the medium 8 is positive or negative (or 0). The head position adjustment in which the influence of the hysteresis is reduced is performed by selecting either one of the first piezoelectric element 13 or the second piezoelectric element 14 to be driven according to each case and changing the discharge end nozzles in each case. Hereinafter, each step S21 to S38 in the flowchart of FIG. 13 will be described. In the present embodiment, the discharge end nozzle means the nozzles at the outermost end among the plurality of nozzles 19 constituting a nozzle row. Hereinafter, unless otherwise specified, in the case of simply referred to as the discharge end nozzle, it means the discharge end nozzle on the side in the first direction.

In step S21, the first drawing discharge is performed, and liquid droplets 25 are discharged on the medium 8 as illustrated in FIG. 7 in the first embodiment. Then, the process proceeds to step S22.

Figure 14:
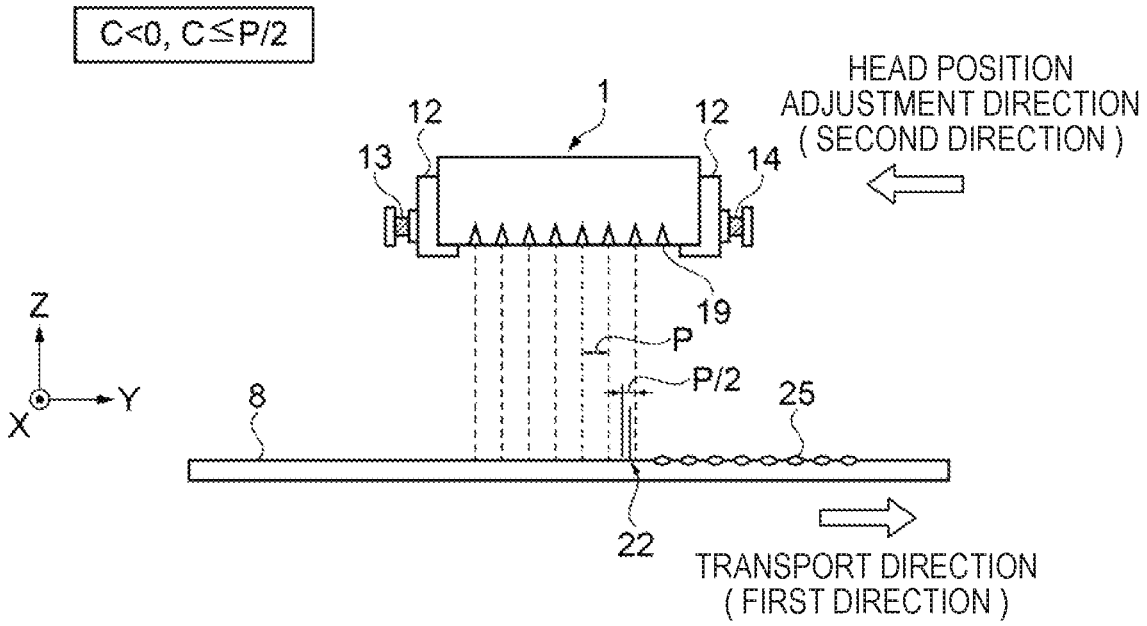
FIG. 14 is a process diagram of the head position adjustment method in the second embodiment.

In step S22, the medium 8 is transported in the first direction depending on the target transport amount A, as illustrated in FIG. 14. The transport of the medium 8 is performed by the control circuit 27 reading the target transport amount A from the memory 26 and sending out a control signal from the control unit 3 to the transport roller drive unit 29 in accordance with the target transport amount A. The target transport amount A is stored in the memory 26 and is determined such that the landed liquid droplets of the first drawing discharge and the landed liquid droplets of the second drawing discharge performed after the transport are arranged at the same pitch. The discharge end nozzle in the second drawing discharge is referred to as a nozzle on the second direction side of the end nozzle of the nozzle row, and the nozzle on the side in the first direction from the discharge end nozzle is referred to as a non-discharge nozzle. It is preferable to set the target transport amount A in accordance with the discharge end nozzle. At this time, it is desirable that the discharge end nozzle is selected in consideration of the estimated transport amount error. Accordingly, when the difference C exceeding the nozzle pitch P (that is, transport amount error) is generated, the adjustment amount of the head position can be reduced by changing the discharge end nozzle. In the present embodiment, the discharge end nozzle is set as a nozzle which is shifted by one on the side in the second direction from the end nozzle of the nozzle row. That is, a single end nozzle is a non-discharge nozzle. Then, the process proceeds to step S23.

In step S23, the transport amount B is measured. The transport amount B is measured by imaging the medium surface (or rear surface) by the transport amount measurement unit 9 according to the signal from the control circuit 27. The measured transport amount B is transferred from the transport amount measurement unit 9 to the control circuit 27. Then, the process proceeds to step S24.

In step S24, the difference C (B−A) between the transport amount B and the target transport amount A is calculated in the control circuit 27. Then, the process proceeds to step S25.

In step S25, whether the difference C between the transport amount B and the target transport amount A is C>0 (positive value), C<0 (negative value) or C=0 is determined in the control circuit 27.

In a case where the difference C is C=0, the adjustment of the discharge position is not performed, the process proceeds to step S38, and the second drawing discharge is performed.

In a case where the difference C is C<0 (negative value), the process proceeds to step S26, and the control circuit 27 determines whether an absolute value |C| of the difference C is |C|≤P/2 or |C|>P/2.

Case 1

In step S26, in the case of |C|P/2, that is, as illustrated in FIG. 14, in the case where the position of the discharge end nozzle is on the downstream side of the transport direction (Y direction) with respect to the target discharge position 22 and the deviation amount thereof is equal to or less than half of the nozzle pitch P, the process proceeds to step S28, and the drive signal (drive voltage) of the second piezoelectric element 14 is calculated. The drive signal (drive voltage) of displacement amount corresponding to an absolute value |C| of the difference C is calculated from the relationship between the drive voltage of the second piezoelectric element 14 and the head position illustrated in FIG. 5. In the present embodiment, Case 1 refers to a case of |C|<0 and |C|≤P/2. After the calculation is completed, the process proceeds to step S32.

Figure 15:
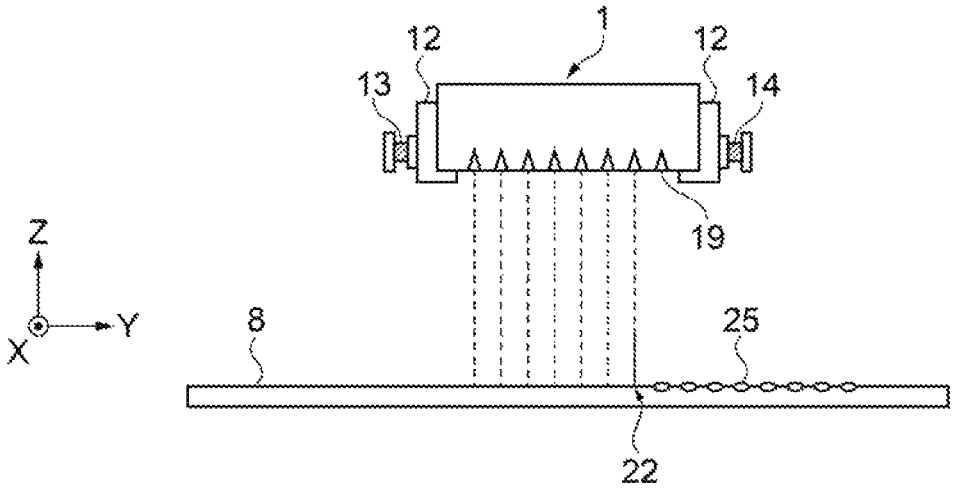
FIG. 15 is a process diagram of the head position adjustment method in the second embodiment.

In step S32, the drive signal (drive voltage) calculated in step S28 is applied to the second piezoelectric element 14 and the adjustment of the head position in accordance with an absolute value |C| of the difference C is performed. As illustrated in FIG. 14, it is possible to move the head 1 in the second direction by the difference C by driving the second piezoelectric element 14. Before applying the drive voltage to the second piezoelectric element 14, a drive signal(drive voltage) for contracting the contracted length of the first piezoelectric element 13 to amount of the extended length of the second piezoelectric element 14 is applied to the first piezoelectric element 13. As a result, the position of the discharge end nozzle can be brought close to the target discharge position 22 as illustrated in FIG. 15. After moving the head 1, the process proceeds to step S38.

Case 2

Figure 16:
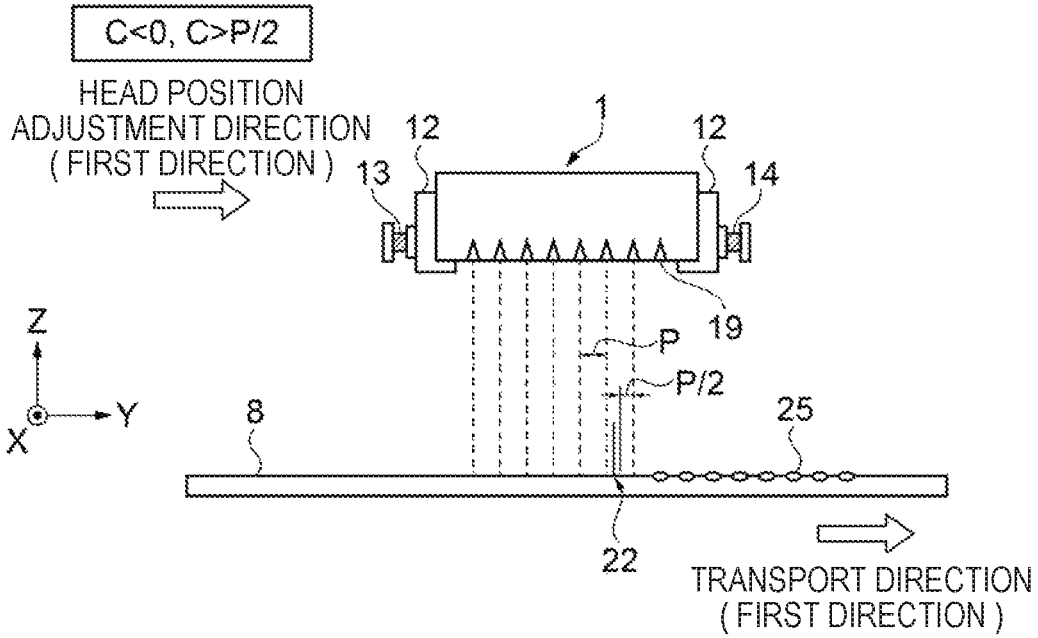
FIG. 16 is a process diagram of the head position adjustment method in the second embodiment.

In the case of |C|>P/2, that is, in the case where a nozzle next to the discharge end nozzle is closer to the target discharge position 22 as illustrated in FIG. 16, the process proceeds to step S29, and the drive signal (drive voltage) of the first piezoelectric element 13 is calculated. In the present example, this case refers to Case 2. The drive signal (drive voltage) of the displacement amount corresponding to an absolute value |C| of the difference C is calculated from the relationship between the drive voltage of the first piezoelectric element 13 and the head position illustrated in FIG. 4. After the calculation is completed, the process proceeds to step S33.

Figure 17:
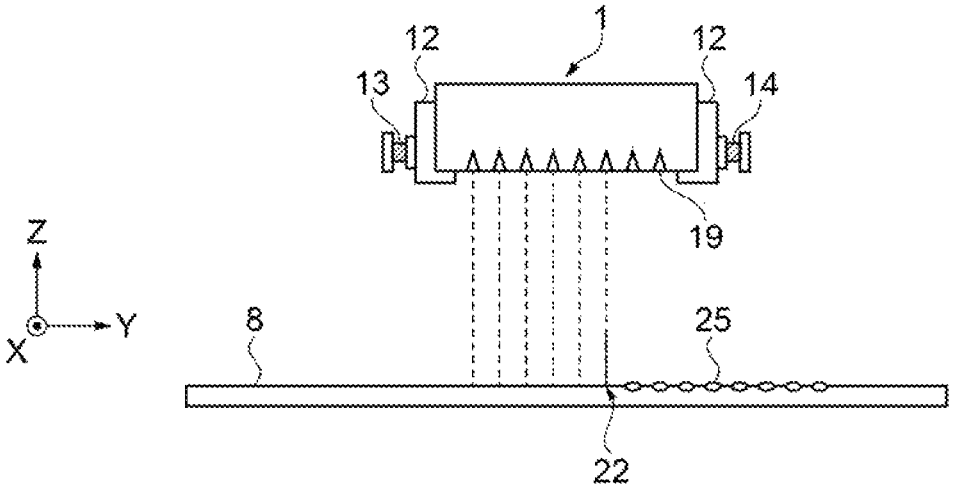
FIG. 17 is a process diagram of the head position adjustment method in the second embodiment.

In step S33, the drive signal (drive voltage) calculated in step S29 is applied to the first piezoelectric element 13 and the adjustment of the head position in accordance with the difference C is performed. As illustrated in FIG. 16, it is possible to move the head 1 in the first direction by driving the first piezoelectric element 13. Before applying the drive voltage to the first piezoelectric element 13, a drive signal (drive voltage) for contracting the contracted length of the second piezoelectric element 14 to amount of the extended length of the first piezoelectric element 13 is applied to the second piezoelectric element 14. Accordingly, as illustrated in FIG. 17, the position of the nozzle adjacent to the discharge end nozzle in the second direction can be brought close to the target discharge position 22. After moving the head 1, the process proceeds to step S36.

In step S36, the discharge end nozzle is changed from the discharge end nozzle set in advance to an adjacent nozzle on the side of the second direction by one nozzle. That is, the discharge end nozzle sets the nozzle on the side in the second direction by two nozzles from the end nozzle. After setting of the discharge end nozzle is completed, the process proceeds to step S38. In the second drawing discharge performed in step S38, the two nozzles at the end of the nozzle row on a side in the first direction become a non-discharge nozzle.

In a case where the difference C is C>0 (positive value), the process proceeds to step S27, and the control circuit 27 determines whether an absolute value |C| of the difference C is |C|P/2 or |C|>P/2.

Case 3

Figure 18:
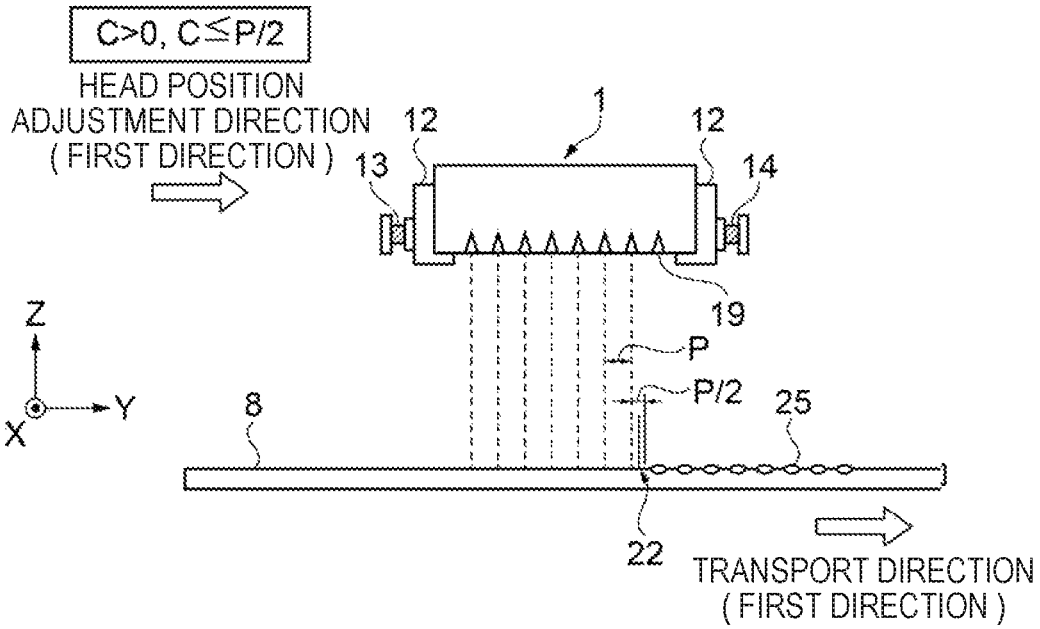
FIG. 18 is a process diagram of the head position adjustment method in the second embodiment.

In the case of |C|≤P/2 in step S27, that is, as illustrated in FIG. 18, in the case where the position of the discharge end nozzle is on the upstream side of the transport direction (Y direction) with respect to the target discharge position 22 and the deviation amount thereof is equal to or less than half of the nozzle pitch P, the process proceeds to step S30 and the drive signal (drive voltage) of the first piezoelectric element 13 is calculated. The drive signal (drive voltage) of the displacement amount corresponding to an absolute value |C| of the difference C is calculated from the relationship between the drive voltage of the first piezoelectric element 13 and the head position illustrated in FIG. 4. In the present embodiment, Case 3 refers to a case of |C|>0 and |C|P/2. After the calculation is completed, the process proceeds to step S34.

Figure 19:
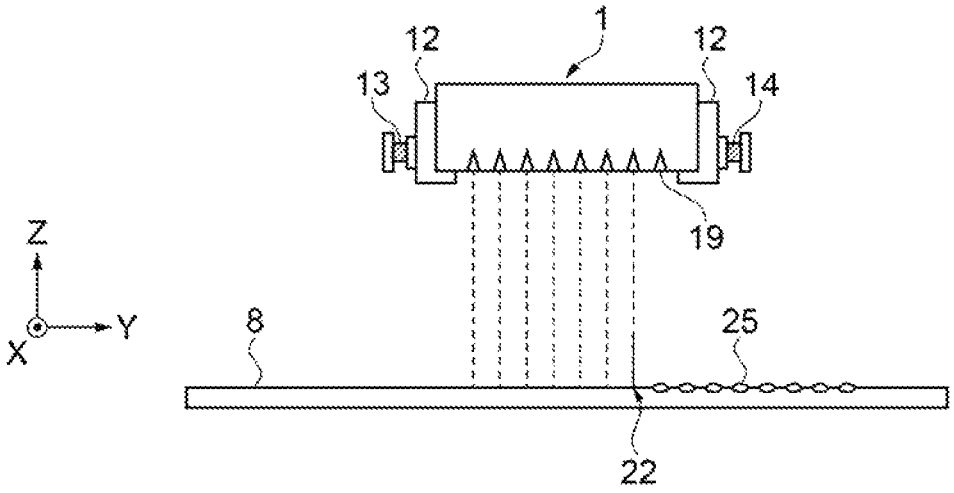
FIG. 19 is a process diagram of the head position adjustment method in the second embodiment.

In step S34, the drive signal (drive voltage) calculated in step S30 is applied to the first piezoelectric element 13, and an adjustment of the head position in accordance with the difference C is performed. As illustrated in FIG. 18, it is possible to move the head 1 in the first direction by an absolute value |C| of the difference C by driving the first piezoelectric element 13. Before applying the drive voltage to the first piezoelectric element 13, a drive signal (drive voltage) for contracting the length of the second piezoelectric element 14 to amount of the extended length of the first piezoelectric element 13 is applied to the second piezoelectric element 14. Accordingly, as illustrated in FIG. 19, the position of the discharge end nozzle can be brought close to the target discharge position 22. After moving the head 1, the process proceeds to step S38.

Case 4

Figure 20:
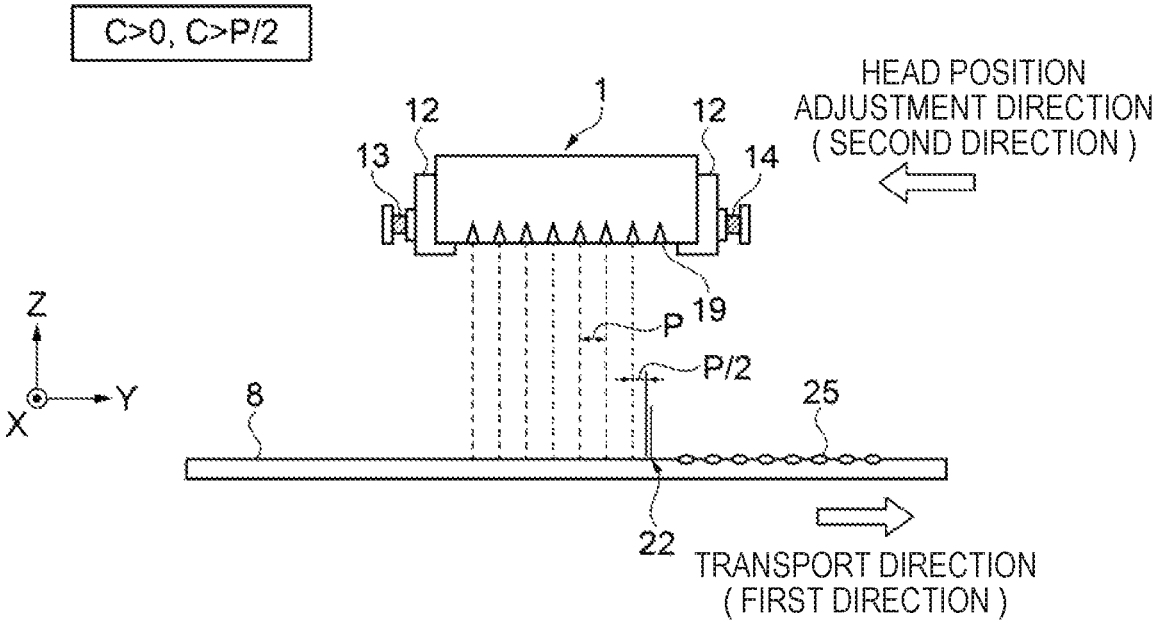
FIG. 20 is a process diagram of the head position adjustment method in the second embodiment.

In the case of |C|>P/2, that is, as illustrated in FIG. 20, in the case where the end nozzle of the nozzle row is closer to the target discharge position 22 than the discharge end nozzle, the process proceeds to step S31, and the drive signal (drive voltage) of the second piezoelectric element 14 is calculated. In the present embodiment, this case is referred to as Case 4. The drive signal (drive voltage) of the displacement amount corresponding to an absolute value |C| of the difference C is calculated from the relationship between the drive voltage of the second piezoelectric element 14 and the head position illustrated in FIG. 5. After the calculation is completed, the process proceeds to step S35.

Figure 21:
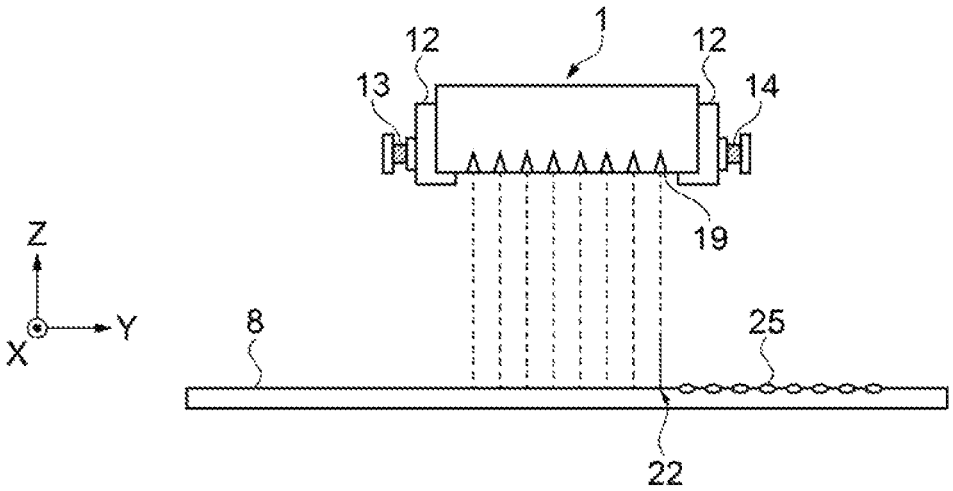
FIG. 21 is a process diagram of the head position adjustment method in the second embodiment.

In step S35, the drive signal (drive voltage) calculated in step S31 is applied to the second piezoelectric element 14, and an adjustment of the head position in accordance with an absolute value |C| of the difference C is performed. As illustrated in FIG. 20, it is possible to move the head 1 in the second direction by driving the second piezoelectric element 14. Before applying the drive voltage to the second piezoelectric element 14, a drive signal(drive voltage) for contracting the contracted length of the first piezoelectric element 13 to amount of the extended length of the second piezoelectric element 14 is applied to the first piezoelectric element 13. Accordingly, as illustrated in FIG. 21, the position of the nozzle adjacent to the discharge end nozzle in the first direction can be brought close to the target discharge position 22. After moving the head 1, the process proceeds to step S37.

In step S37, the discharge end nozzle is changed to an adjacent nozzle in the first direction by one nozzle from the discharge end nozzle set in advance. That is, the end nozzle set as the non-discharge nozzle becomes the discharge end nozzle, and is set as a discharge end nozzle. After setting of the discharge end nozzle is completed, the process proceeds to step S38.

In step S38, the second drawing discharge is performed.

According to the second embodiment, it is possible to reduce the head position adjustment amount for adjusting the discharge position by aligning the nozzles 19 closer to the target discharge position 22. Accordingly, by reducing the head position adjustment amount, it is possible to reduce the drive voltage of the piezoelectric element, that is, the displacement amount of the piezoelectric element. Thereby, since the fluctuation of the displacement amount can be reduced, it is possible to correct the discharge position with higher accuracy.

Third Embodiment

A head position adjustment method of a third embodiment is a method using the liquid droplet discharging apparatus 100A of the first embodiment. In the present embodiment, in the plurality of drawing discharges, the number of times the first piezoelectric element 13 or the second piezoelectric element 14 is continuously driven for each drawing discharge is counted regardless of a value of the difference C between the transport amount B and the target transport amount A. Then, in a case where the number of continuously driven times of one piezoelectric element reaches a specified value, the piezoelectric element to be used is switched to the other piezoelectric element.

According to the present embodiment, it is possible to reduce the piezoelectric element to be used being biased toward one side, and to reduce fluctuation in the displacement amount due to the expansion amount of the first piezoelectric element 13 and the second piezoelectric element 14 reaching the limit.

Fourth Embodiment

A head position adjustment method of a fourth embodiment is a method using the liquid droplet discharging apparatus 100A of the first embodiment. The piezoelectric elements to be used for drawing discharge are alternately switched between the first piezoelectric element 13 and the second piezoelectric element 14 regardless of a value of the difference C between the transport amount B and the target transport amount A.

According to the present embodiment, it is possible to reduce continuous operation of the piezoelectric element to be used, and to reduce fluctuation in the displacement amount due to the expansion amount of the first piezoelectric element 13 and the second piezoelectric element 14 reaching the limit.

The respective configurations described in the above embodiments can be modified as follows, for example. Any of the modification examples described below is positioned as an example of a mode for carrying out the invention.

Modification Example 1

In the liquid droplet discharging apparatus 100A of the above-described embodiment, the head 1 is equipped in the carriage 2, and is configured to reciprocate in the scanning direction. The invention is not limited to this, and the head 1 may not be equipped in the carriage 2 and may not move in the scanning direction. For example, in the liquid droplet discharging apparatus according to the invention, the head 1 may be a line printer configured by a line head in which a plurality of nozzles 19 are arranged in the X direction. In this case, drawing may be performed by discharging liquid droplets from the line head while moving the medium 8 in the first direction by the transport roller drive unit 29 and the transport roller 10 as a movement unit. Alternatively, a movement mechanism for moving the line head in the Y direction as a movement unit may be provided, and drawing may be performed while moving and discharging the line head in the Y direction with respect to the medium 8. In the latter case, a movement amount measurement unit that measures the movement amount of the line head in the Y direction with respect to the medium 8 may be provided, and either one of the first piezoelectric element 13 or the second piezoelectric element 14 may be driven according to the difference B-A between the target movement amount A and the movement amount B measured by the movement amount measurement unit.

Modification Example 2

The liquid droplet discharging apparatus 100A of the above-described embodiment is configured to discharge while the head 1 is reciprocated in the X direction. However, the invention is not limited to this. The main scanning for performing drawing while moving the medium 8 may be performed and the sub-scanning for changing the drawing position may be performed by the head scanning drive unit 7.

Modification Example 3

In the liquid droplet discharging apparatus 100A of the above-described embodiment, the first piezoelectric element 13 and the second piezoelectric element 14 are equipped in the carriage 2 and are configured so as to adjust the head position within the carriage 2. However, the invention is not limited to this. The first piezoelectric element 13 and the second piezoelectric element 14 may be provided outside the carriage 2 and the head 1 may be displaced in the first direction or the second direction with the carriage 2.

Modification Example 4

The liquid droplet discharging apparatus 100A of the above-described embodiment is an ink jet printer. However, the invention is not limited to this. For example, it may be an organic light emitting diode (OLED) manufacturing apparatus using an ink jet method, a wiring forming apparatus, and a liquid droplet discharging apparatus used for manufacturing an electronic device, which are used for industrial use.

The invention is not limited to the above-described embodiments, examples, and modifications, and can be realized in various configurations without departing from the spirit thereof. For example, the technical features in the embodiments, examples, and modifications corresponding to the technical features in each mode described in the Summary can be replaced or combined as appropriate in order to solve some or all of the above problems, or to achieve some or all of the above effects. Also, unless its technical features are described as essential in this specification, it can be deleted as appropriate.

The entire disclosures of Japanese Patent Application No. 2017-158467 filed Aug. 21, 2017 and Japanese Patent Application No. 2018-140029, filed Jul. 26, 2018 are expressly incorporated herein by reference.

What is claimed is:

1. A liquid droplet discharging apparatus that discharges liquid droplets on a medium from a plurality of nozzles included in a head while relatively moving the head and the medium, the liquid droplet discharging apparatus comprising:

a first piezoelectric element that moves the head in a first direction;

a second piezoelectric element that moves the head in a second direction opposite to the first direction;

a movement unit that moves the head or the medium in the first direction in accordance with a predetermined target movement amount A;

a movement amount measurement unit that measures an actual movement amount B of the head or the medium in the first direction; and a drive control unit that controls driving of the first piezoelectric element and the second piezoelectric element based on a difference C between the predetermined target movement amount A and the actual movement amount B, wherein the first piezoelectric element is disposed on a side of the head in the second direction, wherein the second piezoelectric element is disposed on a side of the head in the first direction, and wherein, after the actual movement amount B and the difference C are determined, the drive control unit drives either one of the first piezoelectric element or the second piezoelectric element to correct a position of either the head or the medium according to the difference C, such that a location of the head or medium aligns with the predetermined target movement amount A.

2. The liquid droplet discharging apparatus according to claim 1, wherein the movement unit moves the medium in the first direction, and wherein the drive control unit drives the first piezoelectric element in a case where the difference C is a positive value, and drives the second piezoelectric element in a case where the difference C is a negative value.

3. The liquid droplet discharging apparatus according to claim 1, wherein the movement unit moves the head in the first direction, and wherein the drive control unit drives the second piezoelectric element in a case where the difference C is a positive value, and drives the first piezoelectric element in a case where the difference C is a negative value.

4. The liquid droplet discharging apparatus according to claim 1, wherein the plurality of nozzles are arranged at a pitch P in the first direction, wherein the movement unit moves the medium in the first direction, and wherein the drive control unit drives the first piezoelectric element in a case where the difference C is a positive value and is equal to or less than P/2, drives the second piezoelectric element in a case where the difference C is a positive value and is greater than P/2, drives the second piezoelectric element in a case where the difference C is a negative value and is equal to or less than P/2, and drives the first piezoelectric element in a case where the difference C is a negative value and is greater than P/2.

5. The liquid droplet discharging apparatus according to claim 4, wherein, in a case where the difference C is a negative value and is greater than P/2, the drive control unit changes a discharge end nozzle on the side in the first direction to an adjacent nozzle on the side in the second direction, wherein, in a case where the difference C is a positive value and is greater than P/2, the drive control unit changes the discharge end nozzle on the side in the first direction to an adjacent nozzle on the side in the first direction, and wherein, in a case where the difference C is a positive value and is equal to or less than P/2, or, in a case where the difference C is a negative value and is equal to or less than P/2, the drive control unit does not change the discharge end nozzle on the side in the first direction.

6. The liquid droplet discharging apparatus according to claim 1, wherein the drive control unit switches a piezoelectric element to be driven between the first piezoelectric element and the second piezoelectric element according to a number of times the first piezoelectric element or the second piezoelectric element is continuously driven.

7. The liquid droplet discharging apparatus according to claim 1, wherein the drive control unit alternately drives the first piezoelectric element and the second piezoelectric element.

* * * * *